US006539766B2

(12) United States Patent
Matsuoka

(10) Patent No.: US 6,539,766 B2
(45) Date of Patent: Apr. 1, 2003

(54) ROTARY CAM MOVING APPARATUS FOR NEGATIVE-ANGLE FORMING DIE

(75) Inventor: Mitsuo Matsuoka, Hirakata (JP)

(73) Assignee: Umix Co., Ltd., Osaka (JP)

( * ) Notice: Subject to any disclaimer, the term of this patent is extended or adjusted under 35 U.S.C. 154(b) by 0 days.

(21) Appl. No.: 09/880,021

(22) Filed: Jun. 14, 2001

(65) Prior Publication Data

US 2002/0124620 A1 Sep. 12, 2002

(30) Foreign Application Priority Data

Mar. 21, 2001 (JP) ..... 2001-079971

(51) Int. Cl.[7] ..... B21D 5/04
(52) U.S. Cl. ..... 72/313; 72/387; 72/452.9
(58) Field of Search ..... 72/312–315, 452.4, 72/452.9, 387, 319

(56) References Cited

U.S. PATENT DOCUMENTS 5,347,838 A * 9/1994 Matsuoka ..... 72/313
5,746,082 A * 5/1998 Matsuoka ..... 72/313
5,784,916 A * 7/1998 Matsuoka ..... 72/313
6,196,040 B1 * 3/2001 Matsuoka ..... 72/313
6,230,536 B1 * 5/2001 Matsuoka ..... 72/313

* cited by examiner

*Primary Examiner*—Daniel C. Crane
(74) *Attorney, Agent, or Firm*—Birch, Stewart, Kolasch & Birch, LLP

(57) ABSTRACT

A negative-angle forming die includes a lower die half and an upper die half. A rotary cam is rotatably provided in the lower die half, and a slide cam is slidably opposed to the rotary cam. An automatic retractor is provided in the lower die half for pivoting the rotary cam to a position allowing the work to be taken out of the lower die half after a forming operation. The rotary cam is divided into an end rotary cam and a main rotary cam which are both disposed on a same axis of pivoting. The end rotary cam is not pivoted for an initial predetermined period of the retraction, and thereafter, the end rotary cam is moved axially toward the main rotary cam.

3 Claims, 12 Drawing Sheets

ROTARY CAM MOVING APPARATUS FOR NEGATIVE-ANGLE FORMING DIE

BACKGROUND OF THE INVENTION

The present invention relates to a rotary cam moving apparatus for a negative-angle forming die for forming a sheet metal. Herein, the negative-angle forming die is used for a formation made at a location more inward of a lower die half than a straight downward stroke line of an upper die half.

The negatively angled forming of a work provided as a sheet metal into a shape having a portion more inward of the lower die half than the straight downward stroke line of the upper die half is generally performed by using a slide cam.

According to a prior-art intrusion forming process of the sheet metal work, the work is placed on the lower die half and the upper die half is lowered vertically. At this time a drive cam of the upper die half drives a driven cam of the lower die half, forming the work from a side. After the formation is completed and the upper die half is lifted, then the driving cam is retracted by a spring.

In the above arrangement, the driven cam slid onto the work from the side has a forming portion which is formed as a single piece in the same shape as the work as after the formation. The lower die half however, must allow the work to be taken out from the lower die half after the formation, and for this reason, a portion of the lower die half providing the intrusion formation must be made separable for retraction, or a rear portion thereof must be cut off so that the work can be moved forward and taken out. This does not pose a serious problem if the extent of the intrusion is small. However, the problem becomes serious if the extent of the intrusion is large, or if the work is to be formed into a long frame having a groove-like section such as in a formation of an automobile front pillar-outer from a sheet metal. Specifically, since the groove width of the work is so narrow, that if the portion of the lower die half corresponding to the groove is divided or cut off, it becomes impossible for the forming portion of the driven cam to form clearly. In addition, strength of the lower die decreases. Thus, it was impossible to perform a clear-shaped intrusion formation.

Further, a formed product sometimes has a twist or distortion, which must be corrected. However, for example, many automobile parts that provide the outer skin of the automobile, such as a side panel, fender, roof, bonnet, trunk lid, door panel, front pillar-outer and so on are formed to have a three-dimensional surface or line, and therefore it is practically impossible to make correction after the formation. In assembling the automobile sheet-metal parts, if there is a twist or distortion in the parts, it is difficult to fit the parts together. Without solving this problem, it was impossible to provide a high quality automobile sheet metal structure, and it was impossible to maintain a required level of product accuracy in the formed sheet metal products.

In order to solve the above-described problem, an arrangement was proposed, in which the straight downward stroke of the upper die half is converted to a rotary movement of a rotary cam to pivot to form the portion in the lower die half more inward than the straight downward stroke line of the upper die half. In this arrangement, after the forming operation, the rotary cam is pivoted back to a state where the completed work can be taken out of the lower die. This arrangement will be described in more detail.

Specifically, as shown in FIG. 9 to FIG. 12, this negative-angle forming die comprises a lower die half 102 including a supporting portion 101 on which a work W is placed and an upper die half 103 which is lowered straightly down onto the lower die half 102 to press thereby forming the work W. The lower die half 102 is rotatably provided with a rotary cam 106 supported in an upwardly opening axial groove 104. The groove 104 has a portion close to the supporting portion 101 formed with an intrusion forming portion 105 located more inward than a stroke line of the upper die half 103. The lower die half 102 rotatably supports a rotary cam 106. The upper die half 103 is provided with a slide cam 108 opposed to the rotary cam 106 and provided with an intrusion forming portion 107. The lower die half is further provided with an automatic retractor 109 which moves the rotary cam 106 back to the sate that allows the work W to be taken out of the lower die half 102 after the formation. The work W placed on the supporting portion 101 of the lower die half 102 is formed by the intrusion forming portion 105 of the rotary cam 106 and the intrusion forming portion 107 of the slide cam 108. The work W is formed by a rotary movement of the rotary cam 106 and a sliding movement of the slide cam 108. After the formation, the automatic retractor 109 pivots back the rotary cam 106, allowing the work W to be taken out of the lower die half 102.

Now, an operation of this negative-angle forming die will be described.

First, as shown in FIG. 7, the upper die half 103 is positioned at its upper dead center. At this stage, the work W is placed on the supporting portion 101 of the lower die half 102. The rotary cam 106 is held at its retracted position by the automatic retractor 109.

Next, the upper die half 103 begins to lower, and first, as shown in FIG. 8, a lower surface of the slide cam 108 makes contact with a pivoting plate 111 without causing the slide cam 108 to interfere with the intrusion forming portion 105 of the rotary cam 106, pivoting the rotary cam 106 counterclockwise as in FIG. 8, thereby placing the rotary cam 106 at a forming position. Then, a pad 110 presses the work W.

When the upper die half 103 continues to lower, the slide cam 108 which is under an urge outward of the die half begins a sliding movement as the sliding cam in a laterally rightward direction, against the urge from a coil spring 112. This is a state shown in FIG. 9, where the intrusion forming portion 105 of the pivoted rotary cam 106 and the intrusion forming portion 107 of the slide cam 108 perform formation of the work W.

After the intrusion formation, the upper die half 103 begins to rise. The slide cam 108, which is urged outwardly of the die half by the coil spring 112, moves in a laterally leftward direction as in FIG. 10, and keeps rising without interfering with the work W as after the intrusion formation.

On the other hand, the rotary cam 106 is released from the holding by the slide cam 108, and therefore is pivoted in a rightward direction as in FIG. 10 by the automatic retractor 109. Thus, when the work W is taken out of the lower die half after the intrusion formation, the work W can be removed without interference of the rightward portion with the intrusion forming portion 105 of the rotary cam 106.

As shown in FIG. 11, formation of a flange 211 in the work W is made in a direction not in parallel with but across an axis of pivoting L of the rotary cam 213. After this formation, intrusion formation is performed to form a recessed portion 212. With this arrangement, when the rotary cam 213 retracts, the rotary cam 213 pivots in a retracting direction A of the rotary cam 213, deforming the flange 211 of the work W.

In this work W, the flange 211 is formed and then the recessed portion 212 is formed. As has been described in the prior art, the formation of the recessed portion 212 is made by placing the work W on the lower die half (not illustrated in FIG. 9) and on the rotary cam 213 of the negative-angle forming die. As shown partially in FIG. 11, the flange 211 is supported along a wall surface 214 of the rotary cam 213. The wall surface 214 of the rotary cam 213 is formed along a flange-direction line. After the formation of the recessed portion 212 of the work W, in order to take the work W as after the intrusion formation, the rotary cam 213 pivots back in the retracting direction A, with the work W being left on the lower die half. Because the work W is still in the lower die half when the rotary cam 213 is pivoting back in the retracting direction A, the wall surface 214 of the rotary cam 213 interferes with the flange 211 of the work W, and deforms the flange 211. The interference of the wall surface 214 of the rotary cam 213 with the flange 211 of the work W will not occur if the flange-direction line of the flange 211 is on an orthogonal line vertical to the axis of pivoting L of the rotary cam 213. In the other conditions however, the wall surface 214 will interfere with the flange 211, and deform the flange 211. In FIG. 11, symbol $\alpha$ represents an angle made by the orthogonal line and the flange-direction line. Then, under the condition given as $0°<\alpha<90°$, the wall surface 214 will interfere with the flange 211, and deforms the flange 211. Under the condition of $\alpha \leqq 0°$ ($\alpha$ includes a negative angle), the wall surface 214 will not interfere with the flange 211, and therefore will not deform the flange 211.

In order to prevent the deformation of the flange 211 of the work W caused by the retraction of the rotary cam 213, conventionally, two rotary cams are disposed as show in FIG. 12. Specifically, an end rotary cam 201 is disposed on an axis parallel to the flange-direction line of the flange formed at the end portion of the work, and a main rotary cam 202 for forming the other portion are disposed.

With this arrangement, the end rotary cam 2 has its own axis of rotation $L_1$, whereas the main rotary cam 202 has its own axis of rotation $L_2$, and the two axes are not on a single line. Because the two axes are not on a same line, the negative-angle forming die has to be large, has to have a complex structure, and is expensive. Further, since the end rotary cam 201 and the main rotary cam 202 are not on a single axis but on two separate axes, accuracy is not necessarily sufficient, and it is sometimes impossible to provide a high quality product.

SUMMARY OF THE INVENTION

In consideration of the circumstances described above, the present invention aims to dispose the end rotary cam and the main rotary cam on a same axis, thereby simplifying the negative-angle forming die as much as possible and reducing price, and at the same time aims to improve accuracy, thereby making possible to provide a high quality product. According to the present invention, there is provided a rotary cam moving apparatus for a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein a flange is formed at an end portion of the work in a direction across an axis of the pivoting, the work then undergoing an intrusion formation, the flange at the end portion of the work being protected from damage caused by retraction of the rotary cam, by dividing the rotary cam into an end rotary cam for placing the flange formed at the end portion of the work and the main rotary cam for the other portion, both of the divided rotary cams being disposed on a same axis of pivoting, the end rotary cam not being pivoted for an initial predetermined period of the retraction, thereafter the end rotary cam being moved axially toward the main rotary cam.

Further, the present invention provides, specifically, a rotary cam moving apparatus for a negative-angle forming die, wherein for holding the end rotary cam unmoved for an initial period of the retraction, the end rotary cam is formed with a slant end face facing the main rotary cam, the main rotary cam having an end face including half of the face formed as a slant face for contact with the above slant face and the other half of the face formed as an orthogonal face, a transmission pin being provided on the end face of the main rotary cam facing the end rotary cam, at a place radially spaced from the axis of rotation, the slant surface of the end rotary cam being formed with a long arcuate groove for accepting the transmission pin, an urging member for keeping the end rotary cam in an attitude of the intrusion formation being provided between the end rotary cam and the lower die half, and for moving the end rotary cam toward the main rotary cam after the predetermined amount of pivoting of the main rotary cam, a cam follower being provided at an end portion of the end rotary cam, and the lower die half being formed with a cam groove for guiding the cam follower.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

Embodiment

The present invention will now be described in detail, based on FIG. 1 through FIG. 6 of the attached drawings.

Figure 1A:
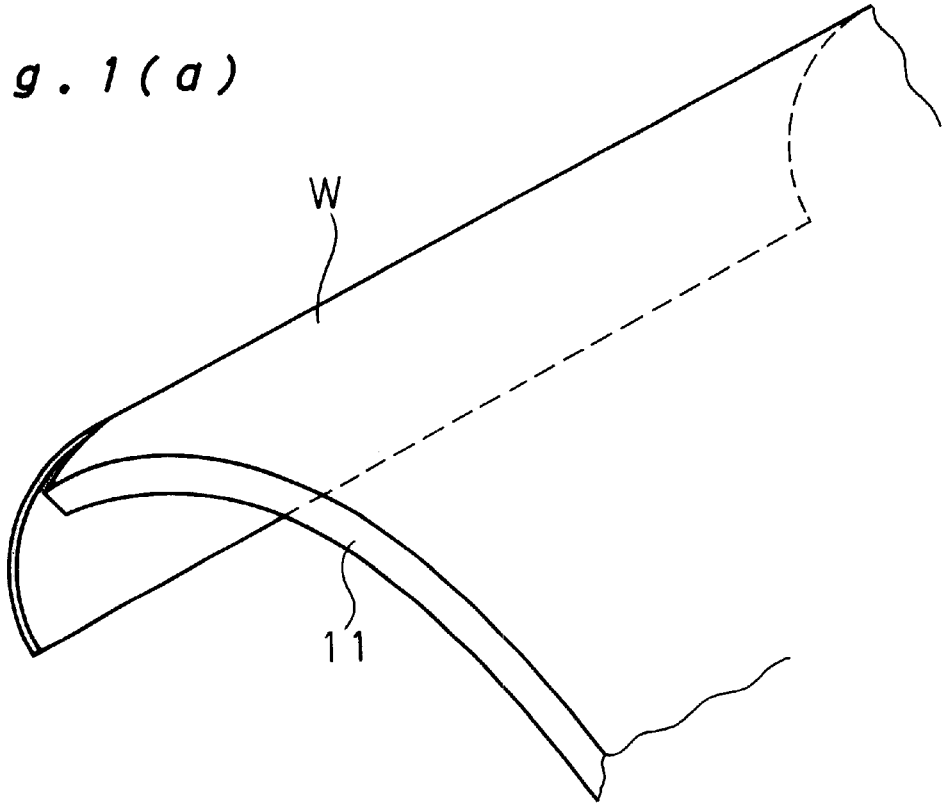
FIG. 1*a* is a perspective view of an automobile sheet-metal part before a formation by the negative-angle forming die according to the present invention.
Figure 1B:
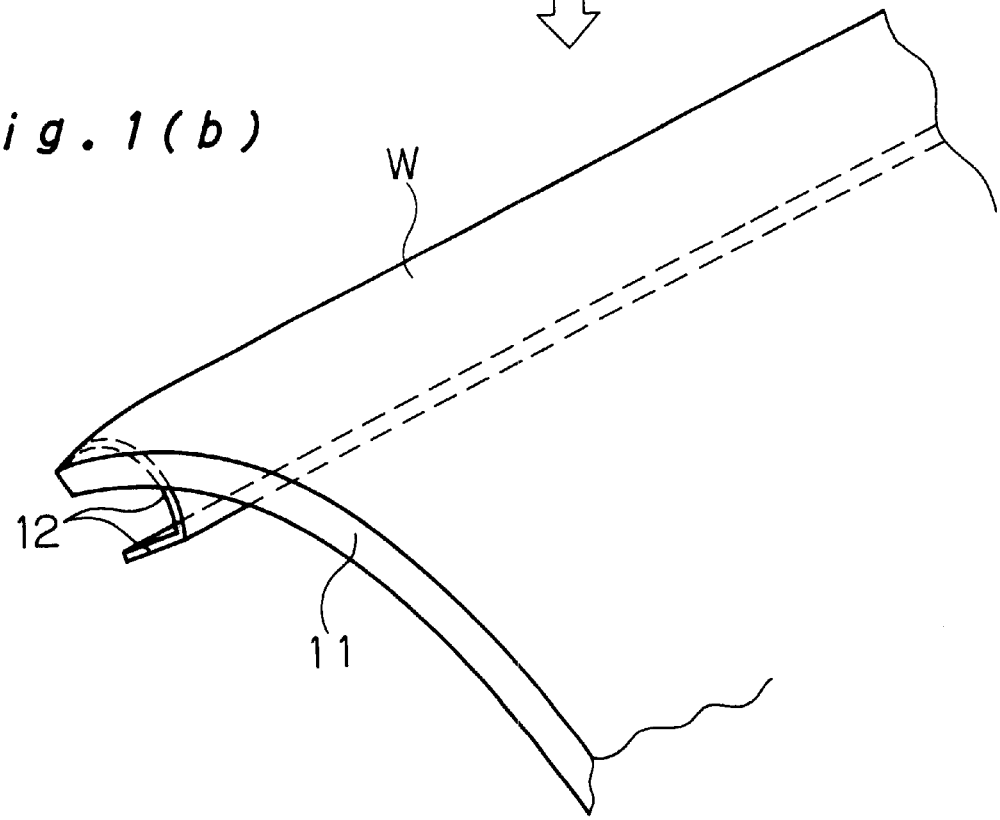
FIG. 1*b* is a perspective view of an automobile sheet-metal part after a formation by the negative-angle forming die according to the present invention.

FIGS. 1*a* and 1*b* show perspective views of an automobile sheet-metal part before and after a formation by the negative-angle forming die. A work W before the formation is already formed with a flange 11 in a direction across an axis of rotation of a rotary cam. An upper portion of the illustration shows a recessed portion formed by an intrusion forming.

It should be noted here that this part is formed to have a three-dimensional curved surface/line to provide an outer skin of the automobile.

Figure 2:
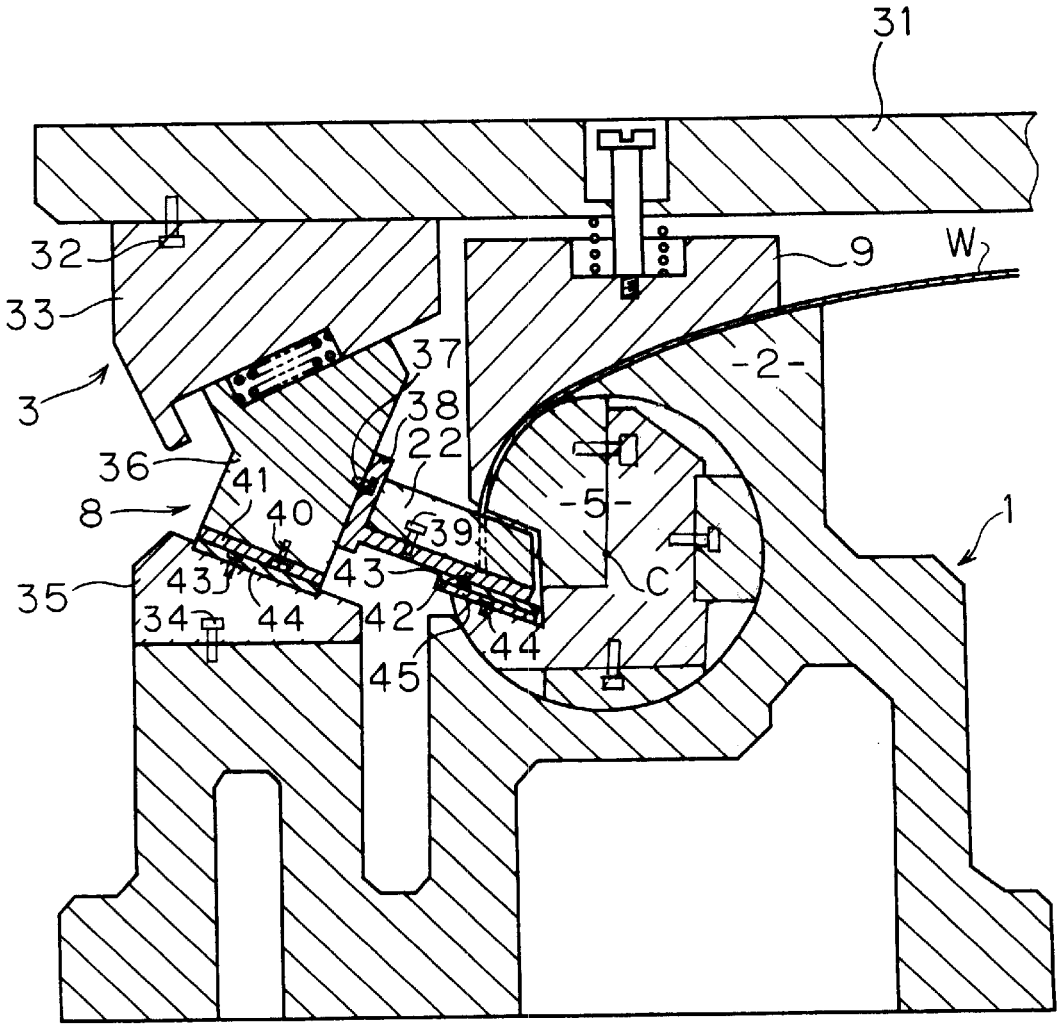
FIG. 2 is a sectional view showing a state of the negative-angle formation according to the present invention

FIG. 2 is a sectional view showing a state of the negative-angle formation. A lower die half 1 has an upper portion formed with a supporting portion 2 for the work W. The lower die half 1 rotatably supports a rotary cam 5, which has a side close to the supporting portion 2, formed with an intrusion forming portion for forming a recessed portion located inward of a stroke line of an upper die half 3. Code C indicates a center of pivoting movement of the rotary cam 5. In order to take the work W out of the lower die half 1 after the work W has been formed, the lower die half 1 is provided with an unillustrated automatic retractor such as an air cylinder.

The upper die half 3 is provided with a slide cam 8 and a pad 9.

The slide cam 8 slides on a driving cam 33 fixed on an upper-die-half base plate 31 by a bolt 32, and further slides on a cam base 35 fixed to the dower die half 1 by a bolt 34.

The slide cam 8 has a base portion 36 provided with a bracket 38 fixed by a bolt 37, where an intrusion forming portion 22 is fixed by a bolt 39.

The base portion 36 of the slide cam 8 slides on a wear plate 41 fixed on a cam base 35 by a bolt 43.

Further, the bracket 38 has a lower surface provided with a wear plate 43 fixed by a bolt 42, which slides on a wear plate 45 fixed to the rotary cam 5 by a bolt 44.

Figure 3:
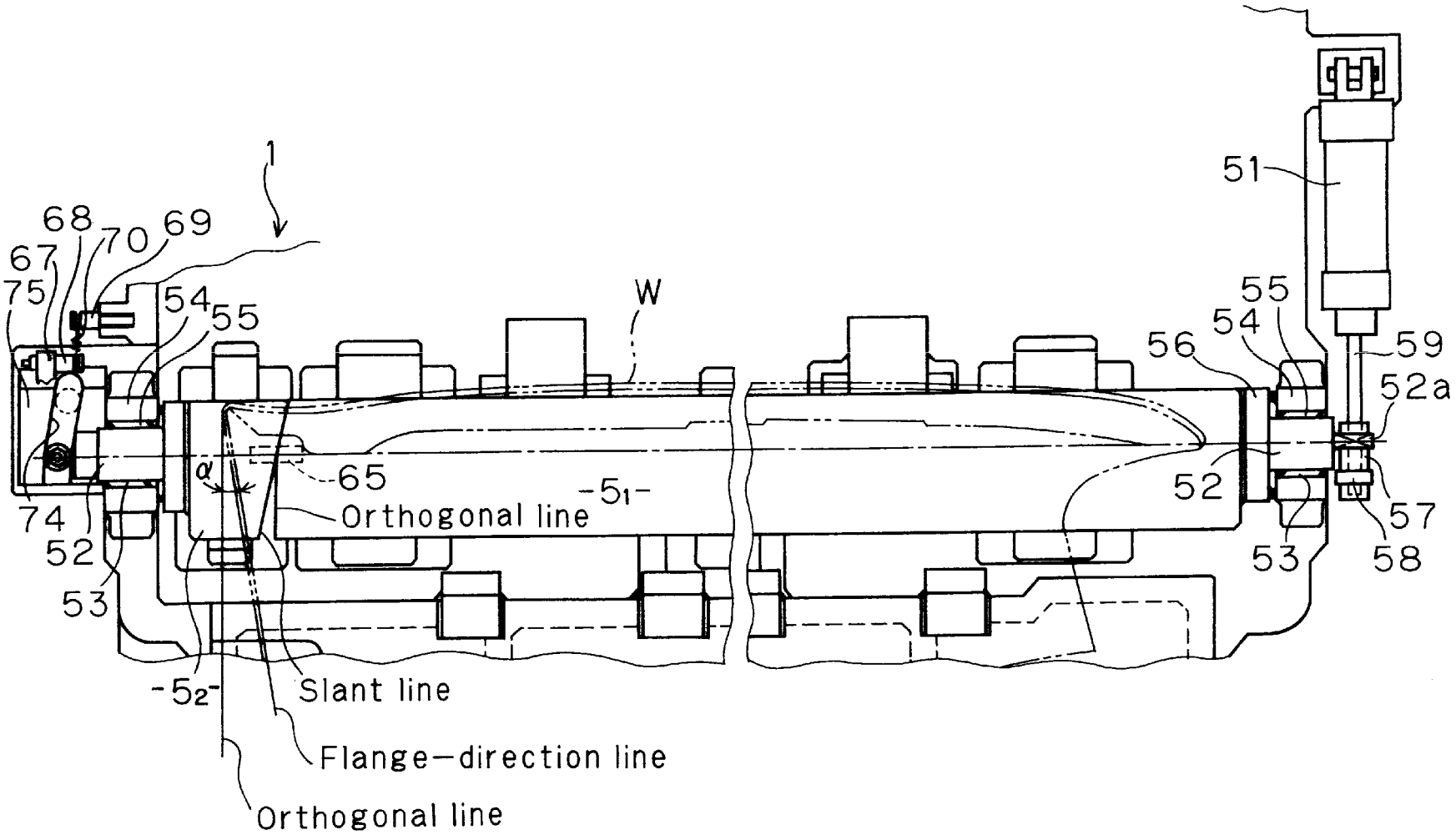
FIG. 3 is a plan view of a lower die half in the state of the negative-angle formation according to the present invention.

FIG. 3 is a plan view of the lower die half 1.

The rotary cam is rotatably supported by the lower die half 1.

The rotary cam 5 is divided into an end rotary cam $\mathbf{5}_1$ for forming a flange 11 of a work W, and a main rotary cam $\mathbf{5}_2$ for forming the other portion, and are disposed in a single axis.

The rotary cams $\mathbf{5}_1$, $\mathbf{5}_2$ are automatically retracted by a cylinder 51 disposed in the lower die half 1. Each of the shaft-like rotary cams $\mathbf{5}_1$, $\mathbf{5}_2$has two ends each provided with a supporting shaft 52, which is rotatably fitted into a metal 53. The metal 53 is fixed to a bearing 54, making the rotary cams $\mathbf{5}_1$, $\mathbf{5}_2$ rotatable. A base plate 56 of the supporting shaft 52 is fixed to an end of the shaft of rotary cams $\mathbf{5}_1$, $\mathbf{5}_2$ by a bolt, and the bearing 54 into which the supporting shaft 53 is fitted is fixed to the lower die half 1 by a bolt.

The supporting shaft 52 has an end portion close to the cylinder 51, formed as a quadrangular prism so that the output from the air cylinder can be reliably transferred to the rotary cams $\mathbf{5}_1$, $\mathbf{5}_2$.

A connecting member 57 has an end fitted by the end of the quadrangular prism 52, and anther end connected with an end of a rod 59 of the cylinder 51 with a pin 58.

By retracting the rod 59 of the cylinder 51, the rotary cams $\mathbf{5}_1$, $\mathbf{5}_2$ are pivoted back in a retracting direction A.

Figure 4A:
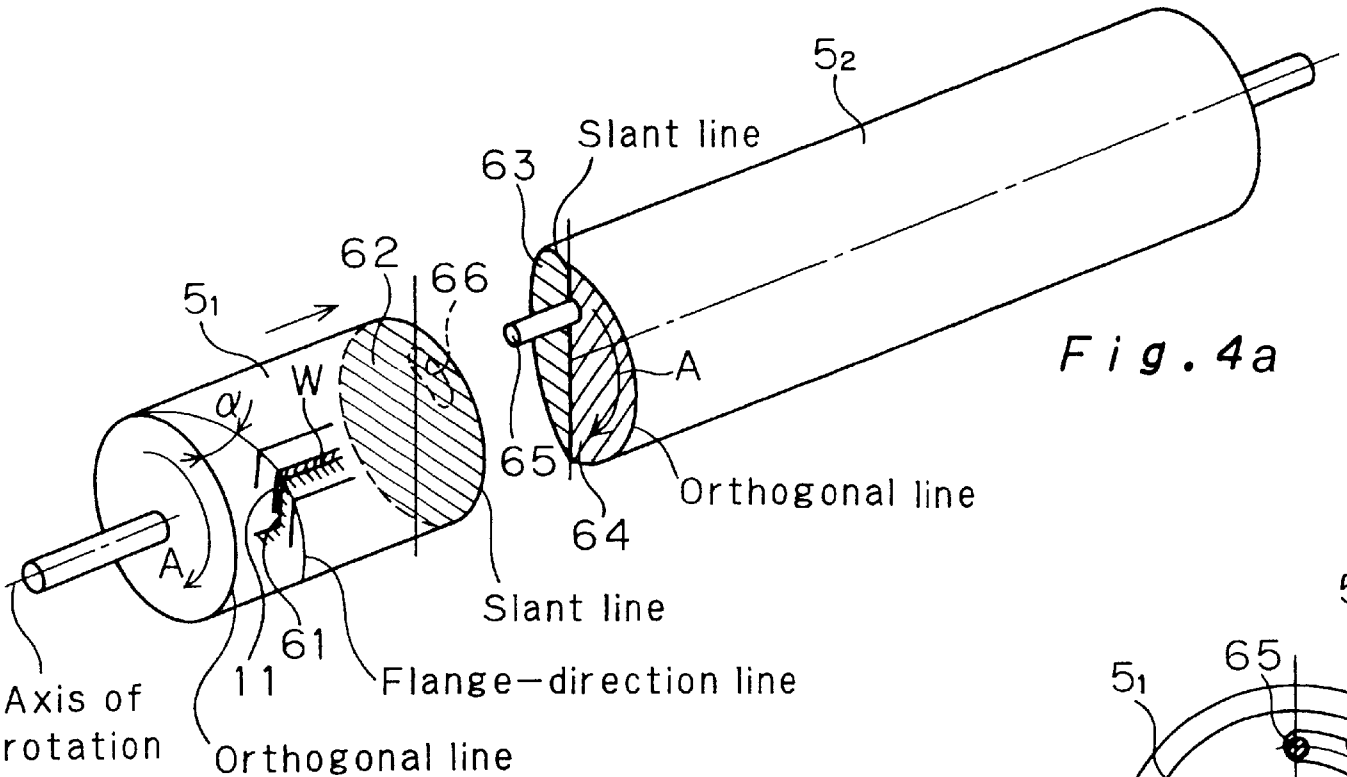
FIG. 4*a* is a conceptual perspective view of a rotary cam according to the present invention.
Figure 4B:
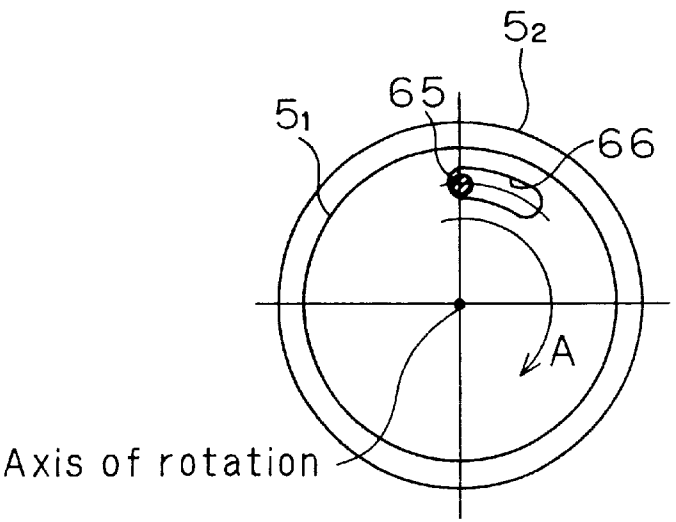
FIG. 4*b* is a conceptual plan view of a rotary cam according to the present invention.

FIG. 4*a* and 4*b* show two views, i.e. a conceptual perspective view and a conceptual front view, of the rotary cam 5 as divided into the end rotary cam $\mathbf{5}_1$ on which the flange 11 of the work W is placed and the main rotary cam $\mathbf{5}_2$ on which the other portion is placed, on a single axis of rotation.

The end rotary cam $\mathbf{5}_1$ is formed with a wall surface 61 along the flanged-direction line of the work W. The flange 11 is placed on the rotary cam $\mathbf{5}_1$ along this flange-direction line.

The end rotary cam $\mathbf{5}_1$ has and end face opposed to the main rotary cam $\mathbf{5}_2$, formed in a slant surface 62 including a slant line across the flange-direction line.

On the other hand, the slant surface 62 of the end rotary cam $\mathbf{5}_1$ is faced by an end face of the main rotary cam, formed in two faces, i.e. a slant surface 63 (a portion above the axis in FIG. 4*a*) including a slant line similar to the one in the slant surface 62, and an orthogonal surface 64 (a portion below the axis in FIG. 4*a*).

The rotating shaft 5 is driven by the cylinder 51, but the end rotary cam $\mathbf{5}_1$ is rotated by a transmission pin 65 projecting out of the end face of the main rotary cam $\mathbf{5}_2$. As shown in FIG. 4*b*, the pin is radially spaced from the axis of FIG. 3 and FIG. 4*b* show a state of intrusion forming. After the intrusion formation, the main rotary cam 52 is pivoted by the cylinder 51 back in the direction A. At this time, if the end rotary cam $\mathbf{5}_1$ is pivoted together with the main rotary cam $\mathbf{5}_2$, the wall surface 61 of the end rotary cam $\mathbf{5}_1$ will deform the flange 11 of the work W. For this reason, the end rotary cam $\mathbf{5}_1$ is held unmoved in a certain range of the pivoting movement of the main rotary cam. Specifically, the main rotary cam $\mathbf{5}_2$ is pivoted but the end rotary cam $\mathbf{5}_1$ is not moved. The end rotary cam $\mathbf{5}_1$ is held unmoved by a long arcuate groove 66 provided in the slant surface 62 of the end rotary cam $\mathbf{5}_1$. In order to keep the end rotary cam $\mathbf{5}_1$ unmoved during a predetermined range of stroke after the intrusion formation, an arm 67 is provided on the end side of the supporting shaft 52. The arm 67 and the lower die half 1 is threaded by hook bolts 68, 69 respectively for hooking an end of a tension spring, and a tension spring 70 is placed between the hook bolts 68, 69. This tension spring 70 keeps the end rotary cam $\mathbf{5}_1$ at the state of intrusion forming via the arm 67. The arm 67 contacts with and thereby stops on a stopper 71 bulged out of the lower die half 1.

As described above, the end rotary cam $\mathbf{5}_1$ is pulled by the tension spring 70 for a certain initial period of the retraction. However, at the end of the initial period of the retraction, driving force from the cylinder 51 is transmitted to the end rotary cam $5_1$, moving the end rotary cam $5_1$ axially, so that the flange 11 of the work W does not interfere with the wall 61 of the end rotary cam $5_1$, allowing the work W as after the intrusion formation to be taken out. When the main rotary cam $5_2$ pivots to a predetermined extent as shown in FIG. 4, the transmission pin 65 makes engagement with an end of the long arcuate groove 66 formed in the end rotary cam $5_1$. At the same time, the end rotary cam $5_1$ is moved toward the main rotary cam $5_2$.

Figure 5:
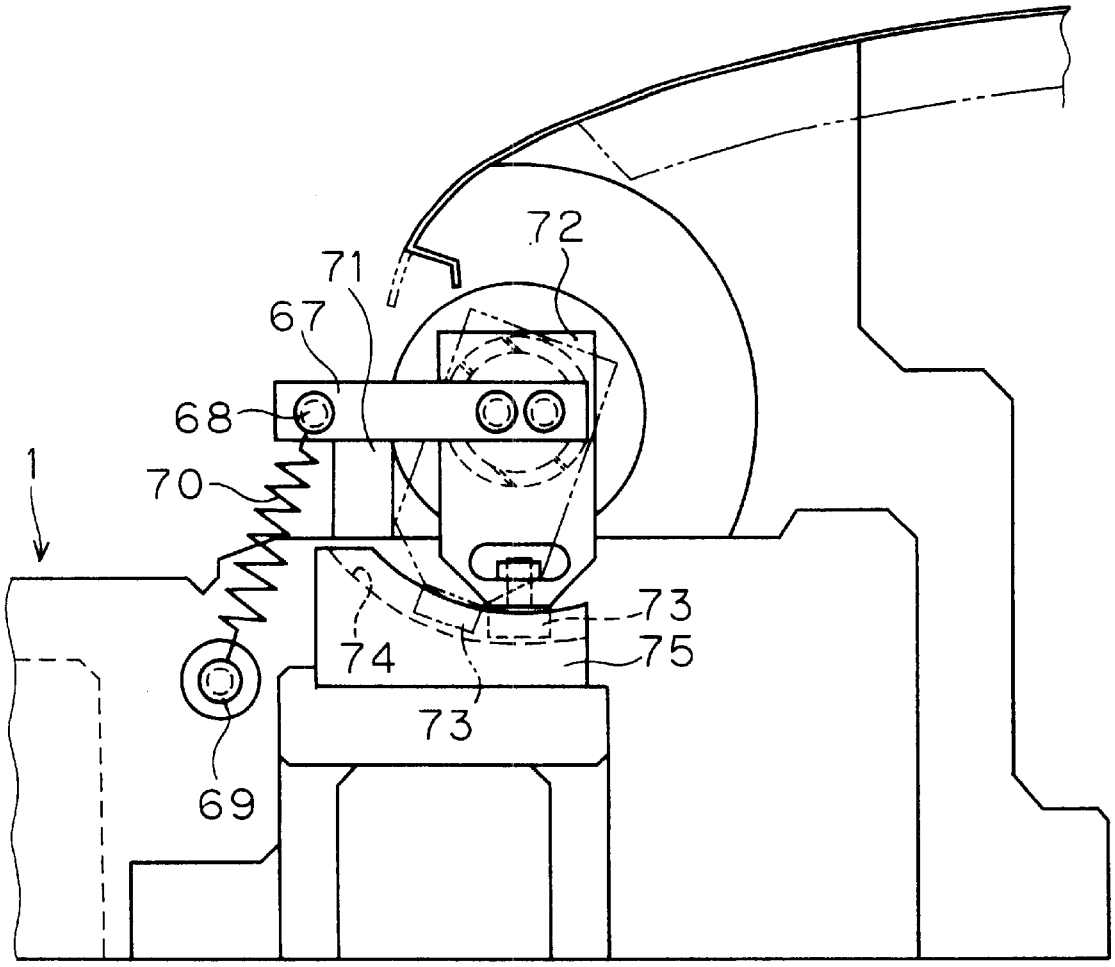
FIG. 5 is a front view showing a state after the intrusion formation in which an end rotary cam is held unmoved by a tension spring, with a cam follower being in a cam groove according to the present invention.

Referring to FIG. 5, a hanging plate 72 is interposed between the arm 67 and an end face of the supporting shaft 52. The hanging plate has a lower end rotatably provided with a cam follower 73.

The lower die half 1 is provided with a cam block 75 formed with a cam groove 74 for guiding the cam follower 73.

After the intrusion formation, the end rotary cam $5_1$ is pulled by the tension spring 70 and therefore is held unmoved, and the cam follower 73 is at a right side as viewed in the figure. Then, the transmission pin 65 reaches an end of the long arcuate groove 66, whereupon the driving force from the cylinder 51 is transmitted to the end rotary cam $5_1$ against the urge from the tension spring 70. As a result, the cam follower 73 moves in the cam groove 74. Specifically, as shown in FIG. 3, the cam groove 73 is formed to be closer to the main rotary cam $5_2$ at an upper point, and therefore, the end rotary cam $5_1$ is moved closer to the main rotary cam $5_2$. The slant surface 62 of the end rotary cam $5_1$ and the slant surface 63 of the main rotary cam $5_2$ are adjusted not to make interference but to allow the end rotary cam $5_1$ to move toward the main rotary cam $5_2$.

According to an operation of the negative-angle forming die provided by the present invention, at an initial period following the intrusion formation, the end rotary cam $5_1$ is held unmoved by the tension spring 70. When the main rotary cam has been retracted to a predetermined extent, then driving force from the cylinder 51 is transmitted to the end rotary cam $5_1$, moving the end rotary cam $5_1$. The end rotary cam $5_1$ is moved by the cam follower 73 along the cam groove 74 toward the main rotary cam $5_2$, so that the flange of the work W is not deformed by the wall surface 61 of the end rotary cam $5_1$.

Figure 6:
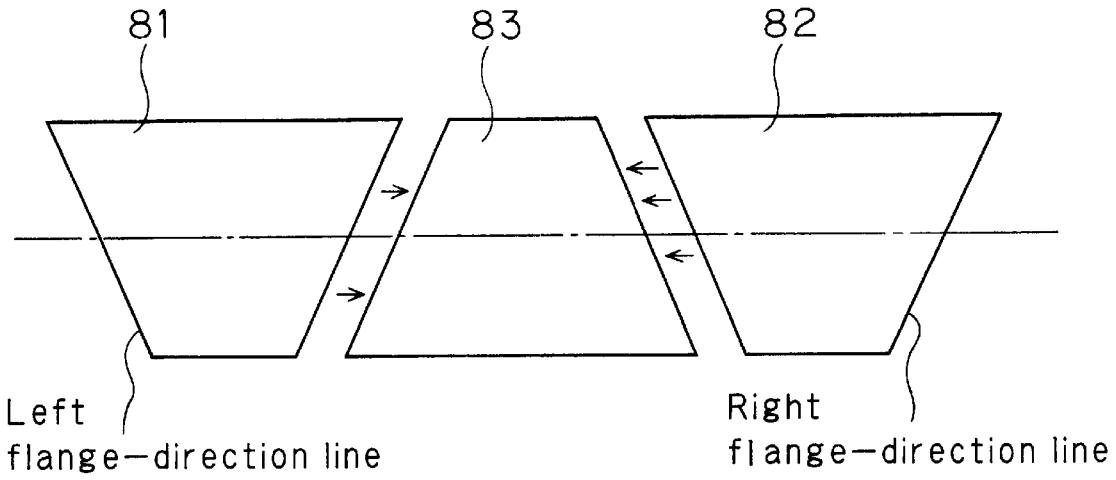
FIG. 6 is an embodiment of the present invention, in which a work has two end portions each formed with a flange which can be deformed by a wall surface of a rotary cam when the cam is retracted.
Figure 7:
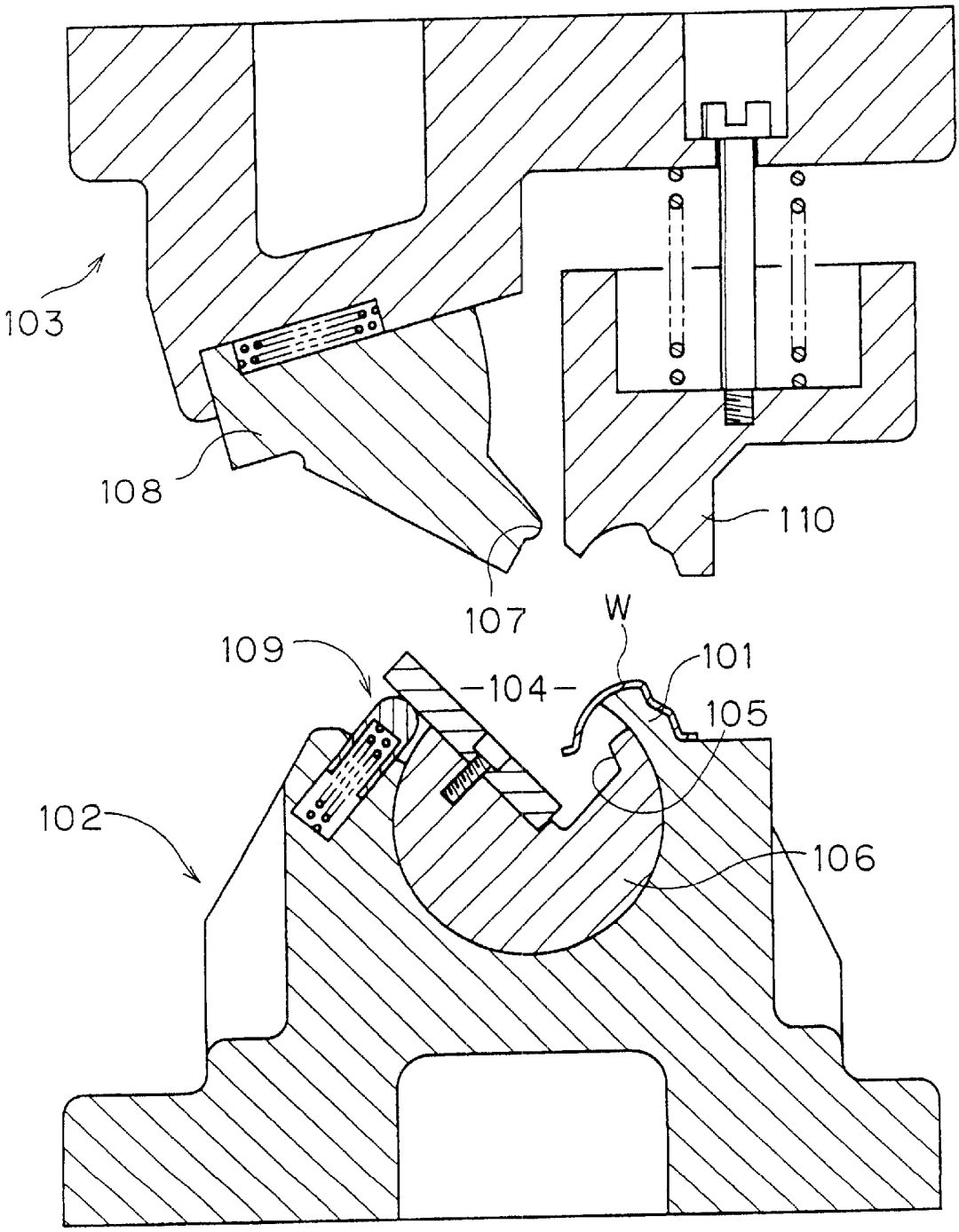
Fig. 7 PRIOR ART
FIG. 7 is a prior art negative-angle forming die for intrusion formation, with its upper die half at an upper dead center.
Figure 8:
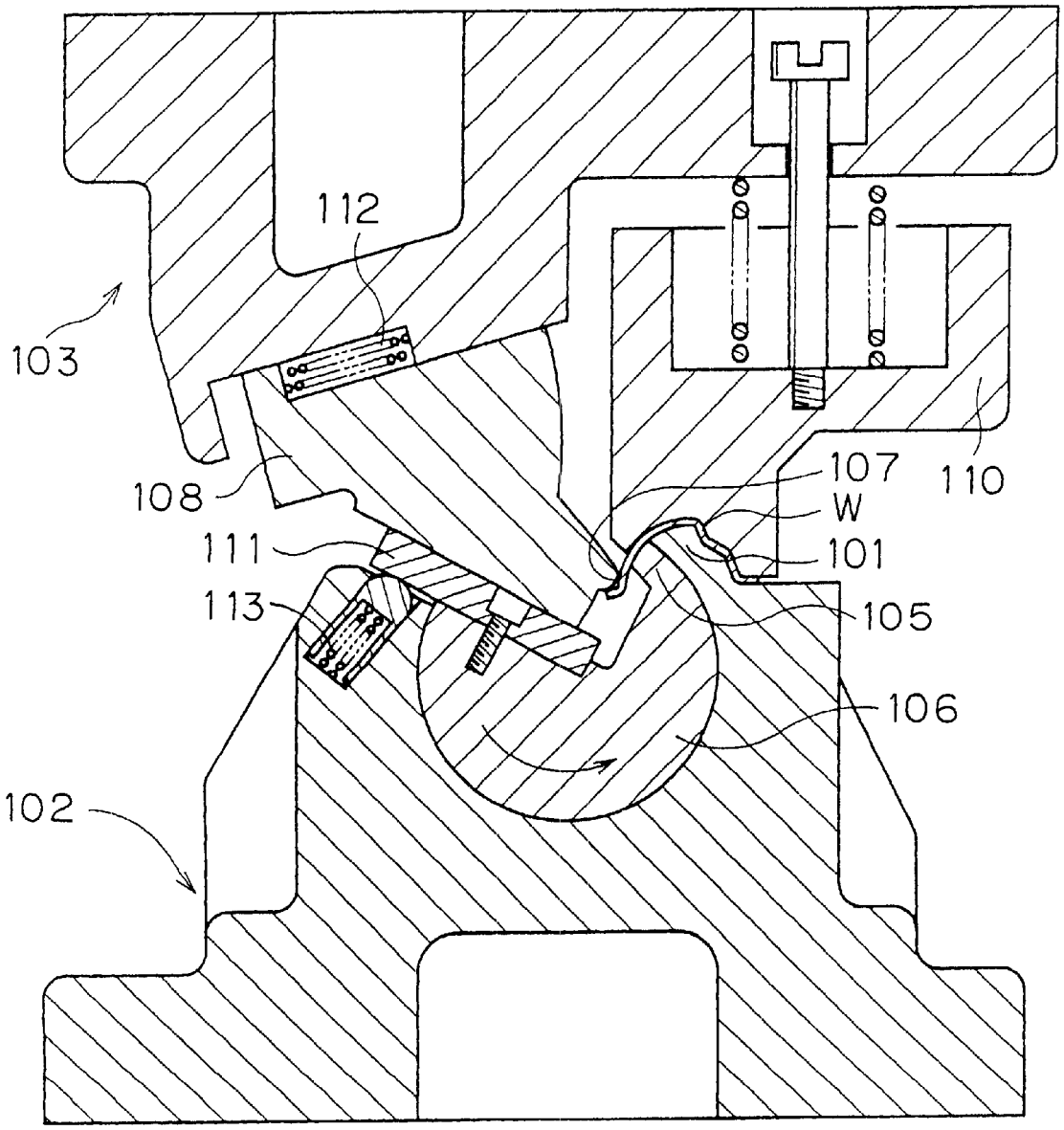
Fig. 8 PRIOR ART
FIG. 8 is a sectional side view of the prior art negative-angle forming die in FIG. 7, with the upper die half in its downward stroke, beginning to contact a lower die half thereby making contact with a work.
Figure 9:
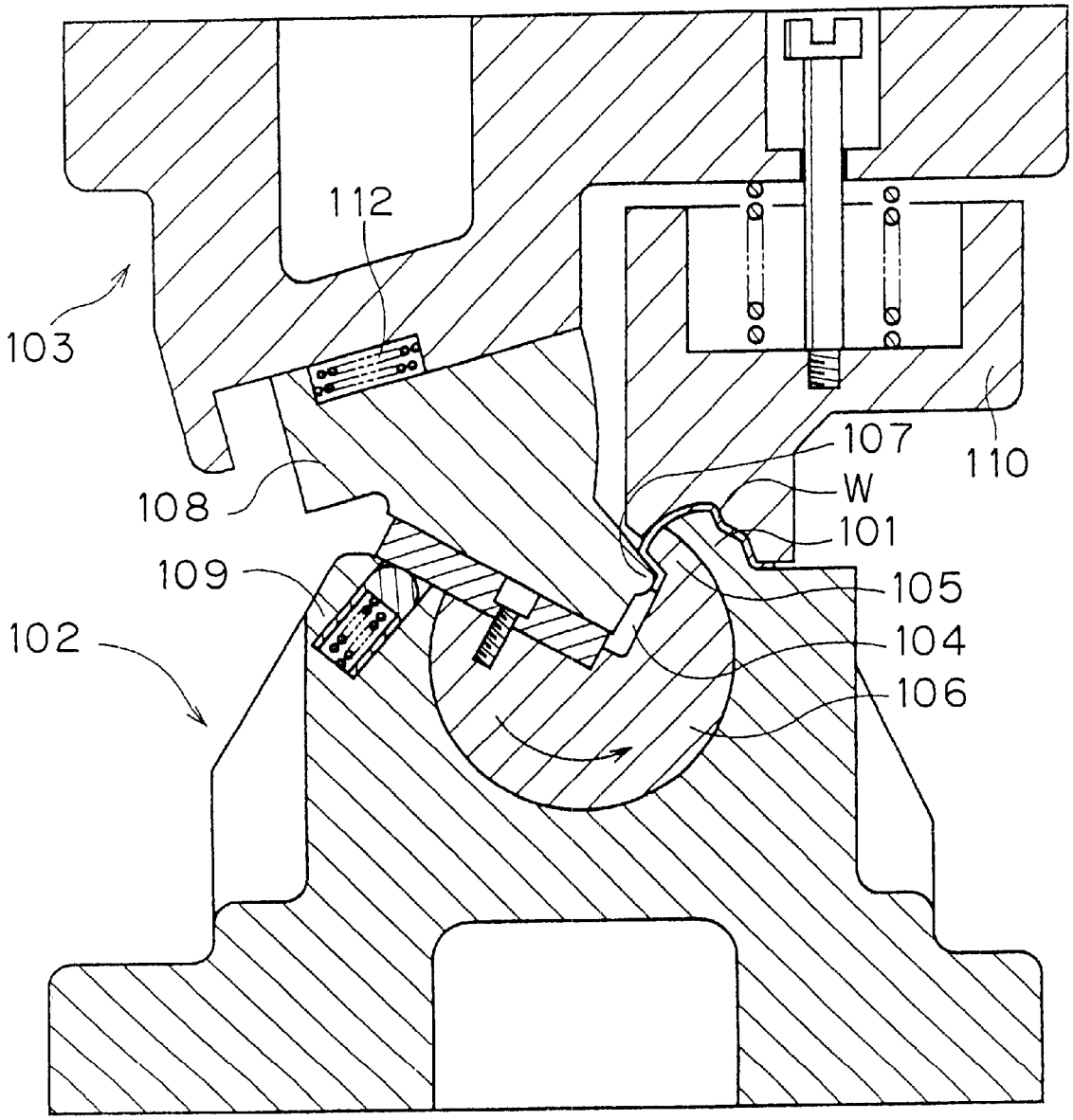
Fig. 9 PRIOR ART
FIG. 9 is a sectional side view of a prior art negative-angle forming die in FIG. 7, with the upper die half being at its lower dead center.
Figure 10:
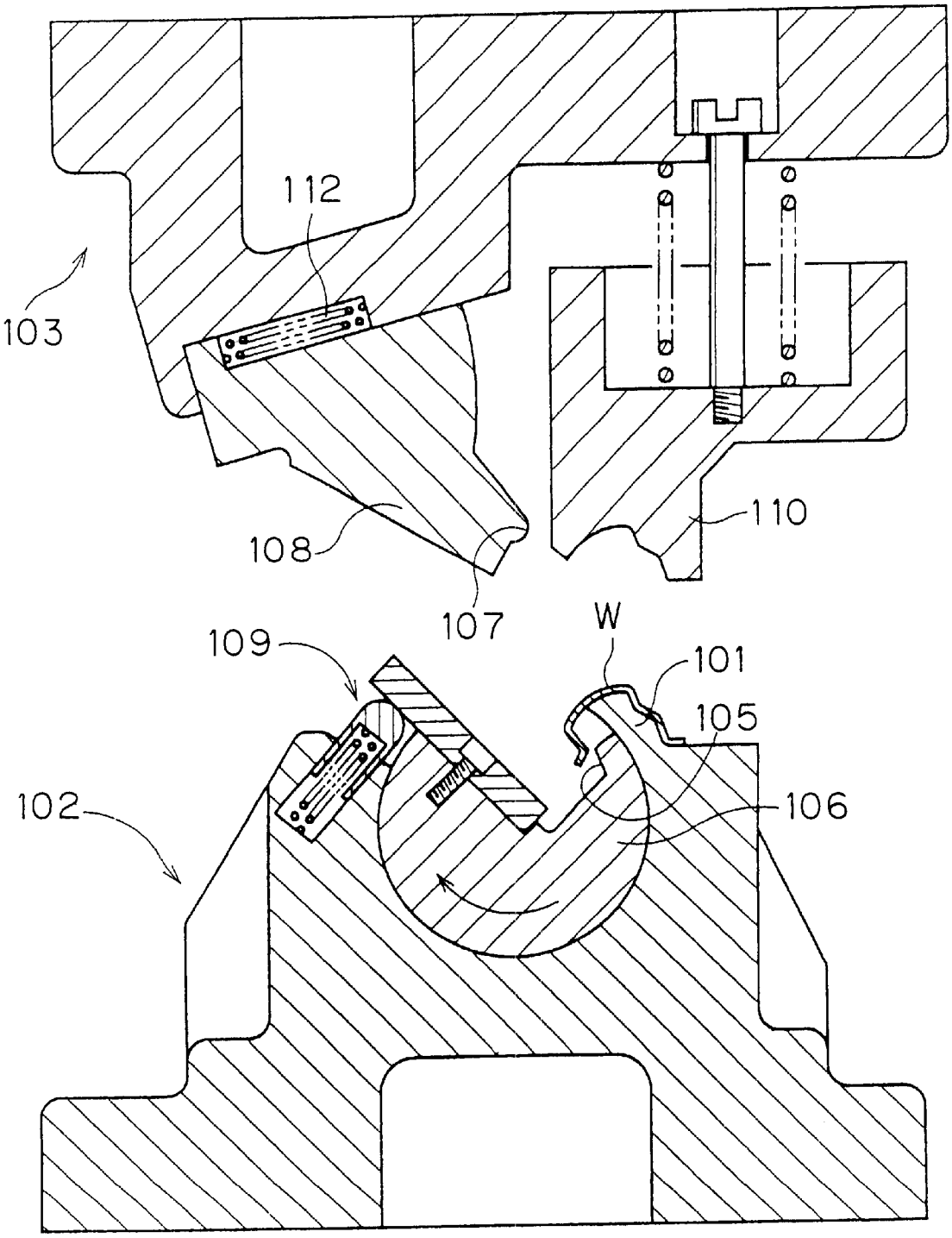
Fig. 10 PRIOR ART
FIG. 10 is a sectional side view of the prior art negative-angle forming die in FIG. 7 as after the intrusion forming, with the upper die half lifted to its upper dead center.
Figure 11:
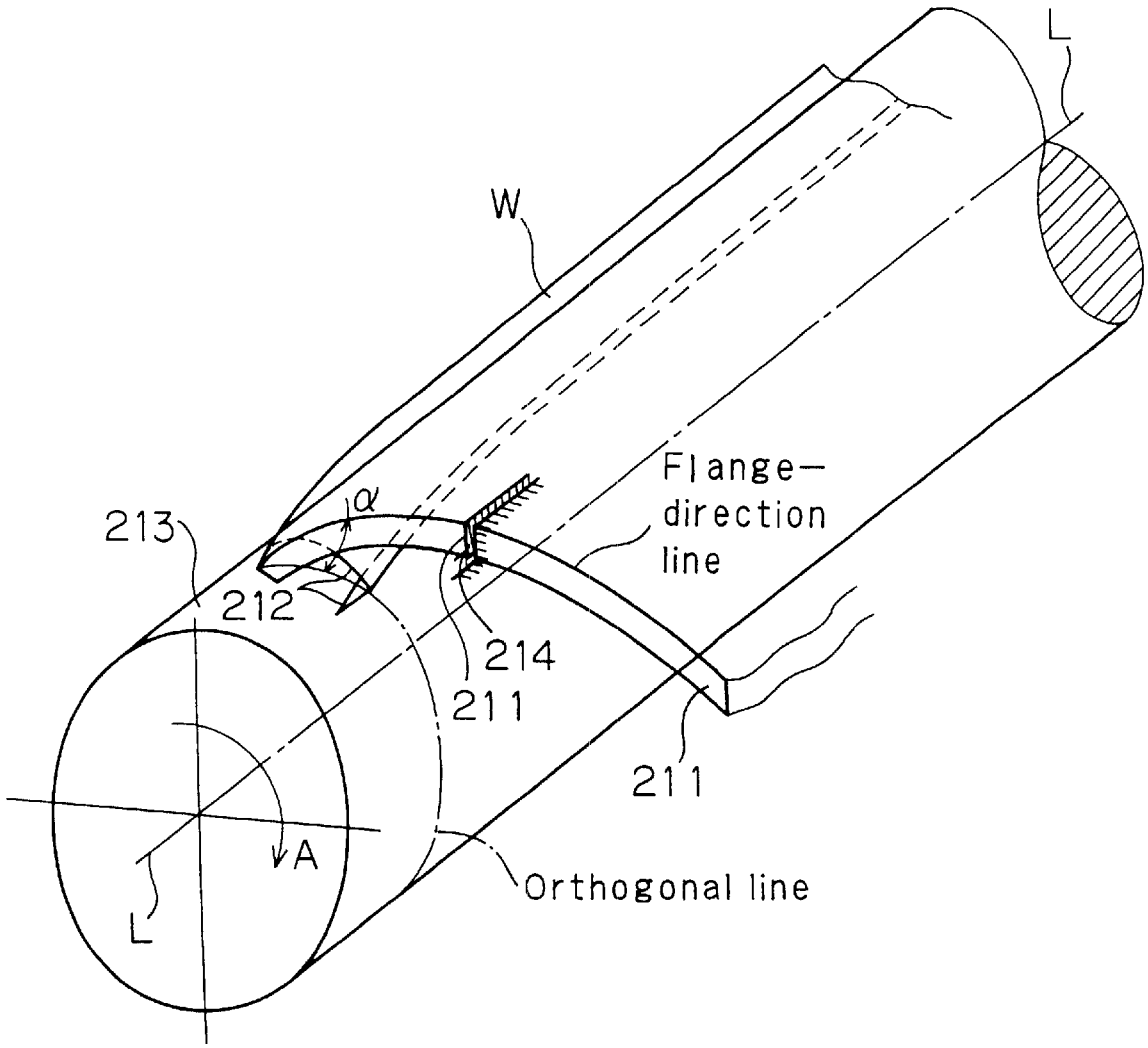
Fig. 11 BACKGROUND ART
FIG. 11 is a perspective view illustrating the deformation of the flange at the end portion of the work.
Figure 12:
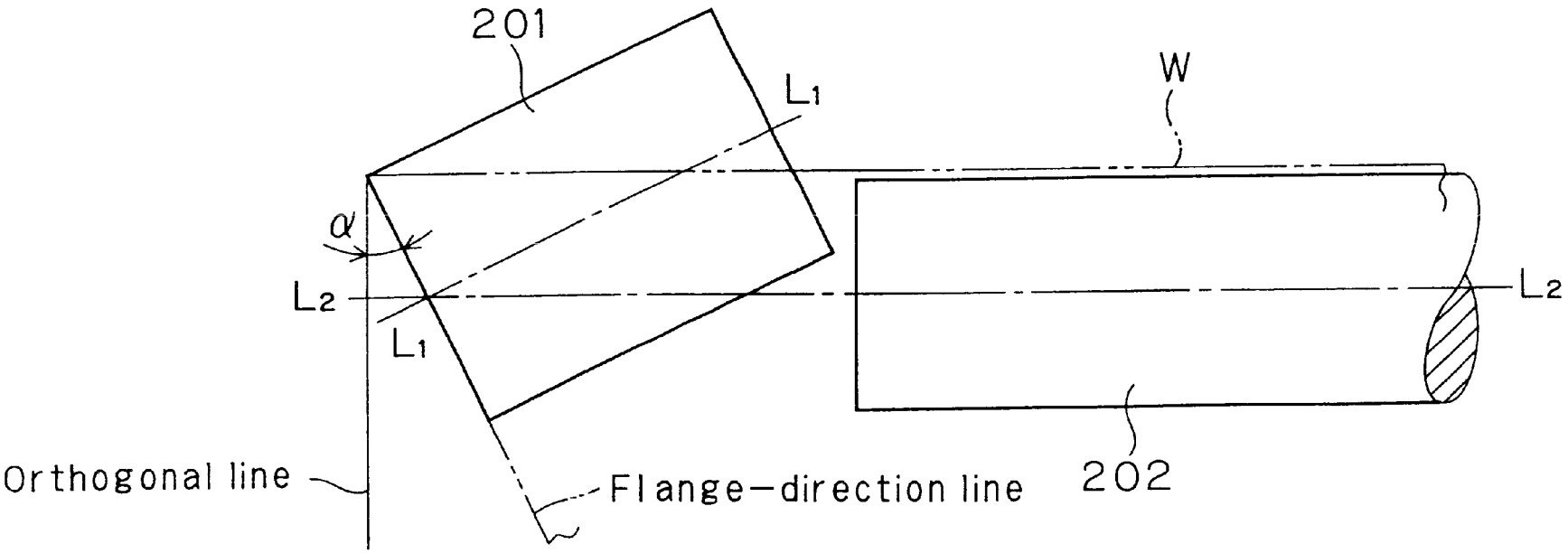
Fig. 12 PRIOR ART
FIG. 12 is a plan view illustrating an arrangement of an end rotary cam and the main rotary cam in the prior art.

In the above, description is made only for a case in which the work W has only one end portion formed with a flange 11. However, as shown in FIG. 6, there is another case in which there are a right flange-direction line and a left flange-direction line, and in which the flange is deformed by the wall surface during the retracting stroke. In such a case as this, a left-end rotary cam 81 and a right-end rotary cam 82 can be moved toward the main rotary cam 83.

The present invention provides, as described above, a rotary cam moving apparatus for a negative-angle forming die comprising a lower die half having a supporting portion for placing a sheet metal work, and an upper die half to be lowered straightly downward onto the lower die half for forming the work, an intrusion forming portion formed in the lower die half at an edge portion near the supporting portion inward of a downward stroke line of the upper die half, a rotary cam rotatably provided in the lower die half, a slide cam including an intrusion forming portion and slidably opposed to the rotary cam, and an automatic retractor provided in the lower die half for pivoting the rotary cam back to a position thereby allowing the work to be taken out of the lower die half after a forming operation, the work placed on the supporting portion of the lower die half being formed by the intrusion forming portion of the rotary cam and the intrusion forming portion of the slide cam, the slide cam forming the work by sliding, the automatic retractor pivoting back the rotary cam after the forming operation for allowing the work to be taken out of the lower die half, wherein a flange is formed at an end portion of the work in a direction across an axis of the pivoting, the work then undergoing an intrusion formation, the flange at the end portion of the work being protected from damage caused by retraction of the rotary cam, by dividing the rotary cam into an end rotary cam for placing the flange formed at the end portion of the work and the main rotary cam for the other portion, both of the divided rotary cams being disposed on a same axis of pivoting, the end rotary cam not being pivoted for an initial predetermined period of the retraction, thereafter the end rotary cam being moved axially toward the main rotary cam. With this arrangement, the negative-angle forming die has been simplified as much as possible, making possible to reduce price, and at the accuracy has been improved, making possible to provide a high quality product.

Further, the present invention provides, specifically, a rotary cam moving apparatus for a negative-angle forming die, wherein for holding the end rotary cam unmoved for an initial period of the retraction, the end rotary cam is formed with a slant end face facing the main rotary cam, the main rotary cam having an end face including half of the face formed as a slant face for contact with the above slant face and the other half of the face formed as an orthogonal face, a transmission pin being provided on the end face of the main rotary cam facing the end rotary cam, at a place radially spaced from the axis of rotation, the slant surface of the end rotary cam being formed with a long arcuate groove for accepting the transmission pin, an urging member for keeping the end rotary cam in an attitude of the intrusion formation being provided between the end rotary cam and the lower die half, and for moving the end rotary cam toward the main rotary cam after the predetermined amount of pivoting of the main rotary cam, a cam follower being provided at an end portion of the end rotary cam, and the lower die half being formed with a cam groove for guiding the cam follower.

What is claimed is:

1. A negative-angle forming die, comprising:

a lower die half having a supporting portion for placing a sheet metal work;

an upper die half to be lowered straightly downward onto the lower die half for forming the work;

an intrusion forming portion formed in the lower die half at an edge portion near the supporting portion;

a rotary cam rotatably provided in the lower die half;

a slide cam including an intrusion forming portion and slidably opposed to the rotary cam; and an automatic retractor provided in the lower die half for pivoting the rotary cam to a position allowing the work to be taken out of the lower die half after a forming operation, the work placed on the supporting portion of the lower die half being formed by an intrusion forming portion of the rotary cam and the intrusion forming portion of the slide cam, the slide cam forming the work by sliding, and the automatic retractor pivoting back the rotary cam after the forming operation for allowing the work to be taken out of the lower die half, wherein a flange is formed at an end portion of the work in a direction across an axis of the pivoting, the work then undergoing an intrusion formation, the flange at the end portion of the work being protected from damage caused by retraction of the rotary cam, the rotary cam being divided into an end rotary cam for placing the flange formed at the end portion of the work and a main rotary cam for the other portion, both the end rotary cam and the main rotary cam being disposed on a same axis of pivoting, the end rotary cam not being pivoted for an initial predetermined period of the retraction, and thereafter the end rotary cam being moved axially toward the main rotary cam.

2. The negative-angle forming die according to claim 1, wherein:

the end rotary cam is formed with a slant end face facing the main rotary cam;

the main rotary cam having an end face, half of the end face formed as a slant face for contact with the slant end face of the end rotary cam and the other half of the end face formed as an orthogonal face;

a transmission pin being provided on the end face of the main rotary cam facing the end rotary cam, at a place radially spaced from the axis of rotation;

the slant end face of the end rotary cam being formed with a long arcuate groove for accepting the transmission pin; and an urging member for keeping the end rotary cam in an attitude of the intrusion formation, the urging member being provided between the end rotary cam and the lower die half, for holding the end rotary cam unmoved for an initial period of the retraction.

3. The negative-angle forming die according to claim 2, further comprising:

a cam follower provided at an end portion of the end rotary cam; and the lower die half being formed with a cam groove for guiding the cam follower, for moving the end rotary cam toward the main rotary cam after the predetermined amount of pivoting of the main rotary cam.

* * * * *